US006264594B1

(12) United States Patent
Iddon

(10) Patent No.: US 6,264,594 B1
(45) Date of Patent: Jul. 24, 2001

(54) DEVICE FOR HANDLING DOCUMENTS

(75) Inventor: Robert Oliver Iddon, Roydon (GB)

(73) Assignee: Printed Forms Equipment Ltd., Loughton Essex (GB)

( * ) Notice: Subject to any disclaimer, the term of this patent is extended or adjusted under 35 U.S.C. 154(b) by 0 days.

(21) Appl. No.: 09/319,591

(22) PCT Filed: Dec. 9, 1997

(86) PCT No.: PCT/GB97/03390

§ 371 Date: Sep. 3, 1999

§ 102(e) Date: Sep. 3, 1999

(87) PCT Pub. No.: WO98/25771

PCT Pub. Date: Jun. 18, 1998

(30) Foreign Application Priority Data

Dec. 9, 1996 (GB) ..... 9625553

(51) Int. Cl.[7] ..... B31B 1/14; B31B 49/00

(52) U.S. Cl. ..... 493/356; 493/231; 493/340; 493/397; 493/405

(58) Field of Search ..... 493/340, 353, 493/356, 354, 352, 397, 405, 231, 383

(56) References Cited

U.S. PATENT DOCUMENTS

| | | | | |
|---|---|---|---|---|
| D. 306,249 | * | 2/1990 | Tamada et al. | D8/61 |
| 2,386,329 | | 10/1945 | McDaniel | 164/15 |
| 4,479,641 | * | 10/1984 | Bean et al. | 270/53 |
| 4,741,105 | * | 5/1988 | Wong | 30/123 |
| 4,988,030 | | 1/1991 | Muramatu et al. | 227/27 |
| 5,709,376 | * | 1/1998 | Ushirogata | 270/58.11 |

FOREIGN PATENT DOCUMENTS

| | | | | |
|---|---|---|---|---|
| 2 195 295 | | 4/1988 | (GB) . | |
| 2 234 690 | | 2/1991 | (GB) . | |
| 2234690A | * | 2/1999 | (GB) | B02C/18/00 |

OTHER PUBLICATIONS

WIPO Publication No. WO 86/01449, International publication date Mar. 13, 1986.
WIPO Publication No. WO 94/05510, International Publication date Mar. 17, 1994.

* cited by examiner

*Primary Examiner*—Ira S. Lazarus
*Assistant Examiner*—Hemant M. Desai
(74) *Attorney, Agent, or Firm*—Fitch, Even, Tabin & Flannery

(57) ABSTRACT

A device for handling documents comprising a housing containing at least three document receiving stations for shredding a document, folding a document, punching holes in a document, fastening a document, and opening an envelope. The stations corresponding to the shredding means, the folding means, and the envelope means may be adjacent, such that they may be driven by a common drive motor. The common motor enables the device to be compact, such that it may be placed on desk for easy access.

11 Claims, 1 Drawing Sheet

DEVICE FOR HANDLING DOCUMENTS

BACKGROUND OF THE INVENTION

Figure 1:
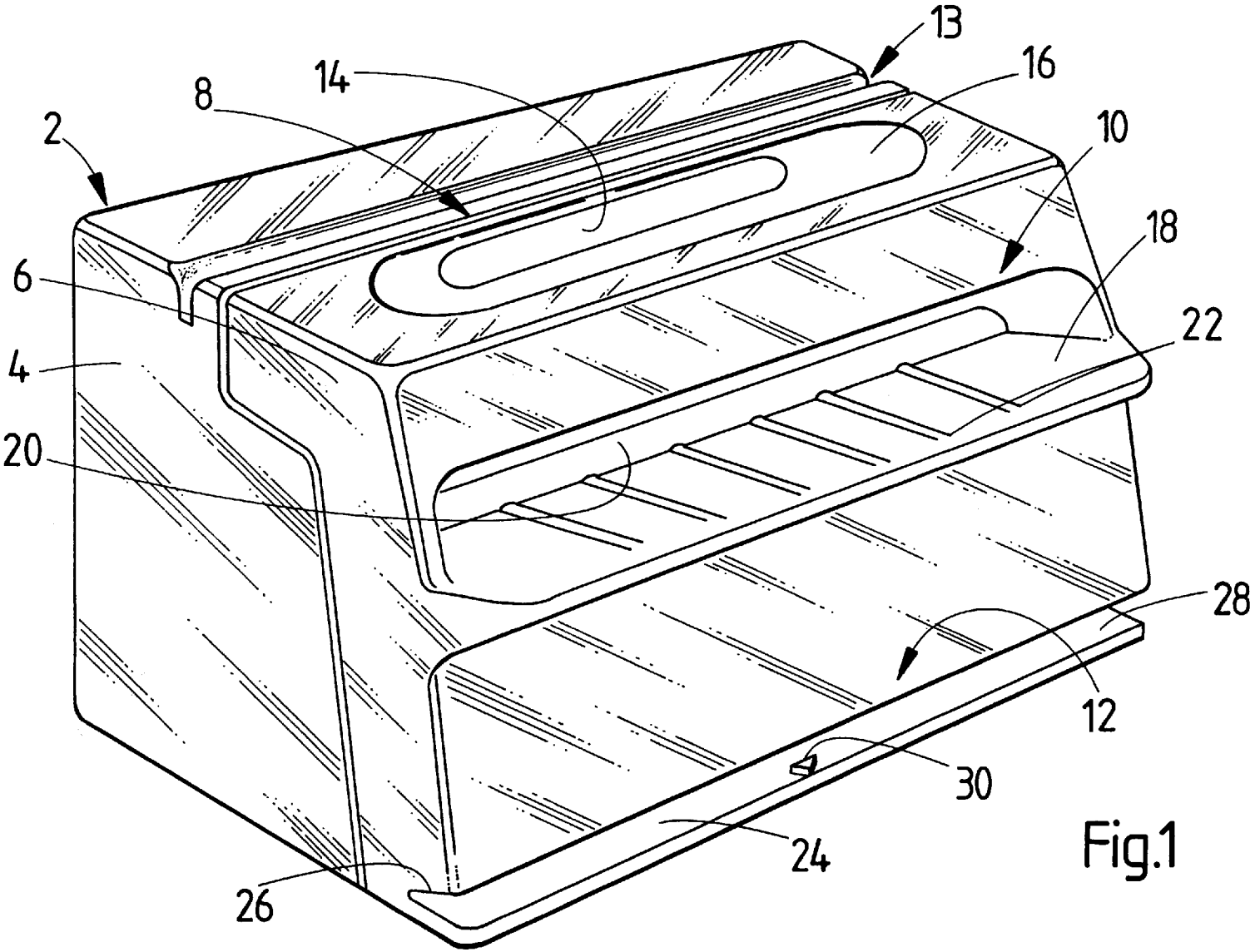

This invention relates to a device for handling documents, and in particular to such a device suitable for use in an office.

Devices are known for performing various functions on documents. Devices such as shredders or paper folding machines are usually bulky and are commonly provided as discrete devices located centrally in an office for use by a number of office staff. Simpler devices such as hole-punchers and staplers are also usually discrete devices, but would normally be provided at each desk for those staff requiring them.

GB 2234690A discloses a paper shredding machine which comprises a letter opener.

WO 86/01449 relates to a combined device for fastening and punching holes in sheets of paper.

It is commonly necessary to perform a number of different functions on a set of documents, or on a set of copies of a single document, when carrying out a particular job. For example, when sending a letter it may be necessary to fasten the letter to an enclosure, fold it for insertion into an envelope, perforate a copy for insertion into a file, and shred a draft copy. Such a job presently involves locating the correct device for each function and marrying it with the correct document or copy, which may involve travelling to a number of different locations in the office, and can therefore be time consuming and complicated.

SUMMARY OF THE INVENTION

The present invention provides a device for handling documents comprising a housing being arranged to present at least three document receiving stations, each station communicating with a different one of either means for shredding a document, or means for folding a document, or means for punching at least one hole in a document, or means for fastening documents together, or means for opening an envelope.

The device preferably includes all of the folding means, shredding means and hole-punching means, and optionally also the fastening means, for example in the form of a stapler, and envelope opening means, for example a rotating blade of small diameter for removing a thin strip from one or more edges of the envelope. The device is conveniently of a size which can be placed on a desk, such that it may be provided to each member of staff requiring those functions.

The document receiving stations corresponding to the shredding and folding means conveniently comprise apertures in the housing, and the stations corresponding to the hole-punching means and envelope opening means may each be a slot for receiving an edge of a document or an envelope respectively. The hole-punching means may for example be a four-hole or three-hole punch, and which may have means for indicating where the perforations will be made.

The station corresponding to the folding means conveniently has a document receiving surface arranged to be substantially horizontal in use, which surface may include guide means for guiding the document into the aperture, the guide means for example being in the form of a plurality of parallel ridges formed on the surface. The folding means preferably may fold the document once or twice, and may include means for the operator to select the number of folds, for example depending upon the size of the envelope into which the document is to be placed.

The housing conveniently comprises a cover member and a base member. The cover member is preferably removable, for example by pivoting away from the base member, to facilitate access to the shredder, folder, hole-puncher, envelope opener, or fastening means, for example for repair or to release a jammed document, or to empty waste material from the shredder, opener or hole-puncher. In this case, the cover member may comprise at least one side of the device which side is preferably arranged to be substantially vertical in use.

The stations corresponding to the shredding means, the folding means and the envelope opening means may be adjacent, such that they may be driven by a common drive motor. This has the advantage of allowing the device to be compact.

DETAILED DESCRIPTION OF THE INVENTION

The invention will now be described by way of example with reference to the accompanying drawings, in which: FIG. 1 is a perspective view of a document handling device according to the present invention.

The device comprises a housing 2 including a base member 6, and a cover member 4 removably mounted on the base member 6. The base member 6 forms a vertical front face of the device, and parts of two side faces and top and bottom faces which surround the front face.

Document receiving stations 8, 10, 12 and 13 are formed in the base member 6. A first station 8 comprises an aperture 14 and a shaped chute 16 surrounding the aperture for guiding a document into the aperture. The first station 8 is formed in that part of the base member 6 forming part of the top face of the device. The aperture communicates with a shredding means, which means are well known in the art and will not be described in detail.

On the front face of the device, the base member 6 includes a second station 10 comprising a document receiving surfaces 18 leading to a second aperture 20.

The second aperture 20 extends laterally across the device, and may for example be sized to receive the short-side of an A4 sized document.

Ridges 22 formed in the surface 18 may assist in guiding the document into the aperture in a direction perpendicular to the lateral axis of the device such that the document is folded with the edges thereof aligned.

The second aperture 20 communicates with a folding device such as is well known in the art. A switch (not shown) may be provided for selecting the number and/or configuration of the folds to be made. For example, an A4 sized document may be folded twice parallel to the shorter side thereof for insertion into a 'DL' sized envelope, or once for insertion into a 'C5' sized envelope.

The third station 12 comprises a lateral slot 24 extending all the way across the device so as to be open at each end 26 and 28, such that the edge of a document which may be larger than the lateral dimension of the device (for example the long edge of A4 document) may be inserted therein. Hole-punching means of the known type are arranged to extend into the slot 24. Thus four, three or two punches may extend between the top and bottom of the slot 24. A centre mark 30 is providing adjacent the outer edge of the slot 24 to indicate the position of the punches. The slot may also comprise a fastening station, for example a stapler, located at one end 26 or 28 of the slot.

The fourth station 13 comprises another open-ended slot 15 provided in the top face of the cover member 4, adjacent the first station 8 (although this slot could alternatively be provided in another convenient position such as in the side of the device, for example adjacent the second aperture 20). A pair of cooperating rotatable blades (not shown) are provided across the slot near its base for cutting off an edge of an envelope passed therethrough, in a known manner.

The shredder and folder mechanisms are mounted such that a common motor (not shown) may be used for driving these mechanisms. For example, when a document is inserted into the first aperture 14, a sensor may activate the motor to drive rollers for gripping and transporting a document in both the first and second apertures.

What is claimed is:

1. A document handling device comprising:

a housing, at least three different document handling stations each comprising:

a document dedicated receiving aperture, a document handling apparatus selected from the group consisting of a document shredder, document folder, a document hole-puncher, for punching at least one hole in a document, a document fastener, and an envelope opener and combinations thereof, wherein all three document handling stations are contained within the housing.

2. A device as claimed in claim 1, in which the document fastener comprises a stapler.

3. A device as claimed in claim 1, in which the envelope opener comprises a pair of cooperating blades arranged to rotate in order to remove a thin strip from one or more edges of an envelope.

4. A device as claimed in claim 1, in which the document dedicated receiving apertures each comprise an aperture in the housing.

5. A device as claimed in claim 1, in which the document dedicated receiving apertures corresponding to the document hole puncher and the envelope opener each comprise a slot for receiving an edge of a document.

6. A device as claimed in claim 1, in which the document hole puncher includes means for indicating the position(s) of the hole(s) to be punched.

7. A device as claimed in claim 1, in which the station corresponding to the document folder comprises an aperture and a document receiving surface arranged to be substantially horizontal in use, which surface includes guide means for guiding the document into the aperture.

8. A device as claimed in claim 1, in which the document folder is arranged to fold a document selectively either once or twice, and includes means for selecting the number of folds.

9. A device as claimed in claim 1, in which the housing comprises a base member and a removable cover member for providing access to the document shredder, the document folder, the envelope opener, the document hole-puncher, and the document fastener.

10. A device as claimed in claim 9, in which the cover member comprises at least a portion of one side of the device, which side is arranged to be substantially vertical in use.

11. A device as claimed in claim 1, in which the stations corresponding to at least two of the document handling apparatuses are adjacent, and comprise a common drive motor for driving the said document handling apparatuses.

* * * * *